US007617996B2

(12) United States Patent
Lee

(10) Patent No.: US 7,617,996 B2
(45) Date of Patent: Nov. 17, 2009

(54) SPRAYING HEAD FOR BATHING

(75) Inventor: Chin-Tsai Lee, Chang Hua Hsien (TW)

(73) Assignee: Ching Shenger Co., Ltd., Chang Hua Hsien (TW)

( * ) Notice: Subject to any disclaimer, the term of this patent is extended or adjusted under 35 U.S.C. 154(b) by 463 days.

(21) Appl. No.: 11/608,108

(22) Filed: Dec. 7, 2006

(65) Prior Publication Data

US 2008/0134429 A1 Jun. 12, 2008

(51) Int. Cl.
*F23D 14/68* (2006.01)

(52) U.S. Cl. ..... 239/553.3; 239/456; 239/548; 239/553; 239/558; 239/567; 239/590.3

(58) Field of Classification Search ..... 239/390–397, 239/436–442, 456, 530, 532, 536–541, 553–553.5, 239/548, 558, 567, 589, 590.3, 59.5, 596
See application file for complete search history.

(56) References Cited

U.S. PATENT DOCUMENTS 1,229,327 A * 6/1917 Schnaier ..... 239/553.3
6,241,166 B1 * 6/2001 Overington et al. ..... 239/553.3
6,739,527 B1 * 5/2004 Chung ..... 239/558
7,077,342 B2 * 7/2006 Lee ..... 239/589
7,093,780 B1 * 8/2006 Chung ..... 239/587.1
7,347,388 B2 * 3/2008 Chung ..... 239/567

* cited by examiner

*Primary Examiner*—Len Tran
*Assistant Examiner*—Jason J Boeckmann
(74) *Attorney, Agent, or Firm*—Alan Kamrath; Kamrath & Associates PA

(57) ABSTRACT

A spraying head for bathing comprises an outer housing and an inner housing. In a center of a top edge of the outer housing is mounted a locking seat having plural water outlet openings and outer threads, and an engaging section mounted with a water-stop ring is formed on a lower end of the locking seat. The inner housing is mounted in the outer housing, and the inner housing is combined with a water outlet panel and is mounted with a locking assembly having inner threads and an abutting flange. The inner threads of the locking assembly are threaded with the outer threads of the locking seat in such a manner that the abutting flange is abutted against the water-stop ring, so as to form a sealing condition. And a bolt cooperates with a spacer and a nut enabling the water outlet panel to fix in the locking seat.

3 Claims, 7 Drawing Sheets

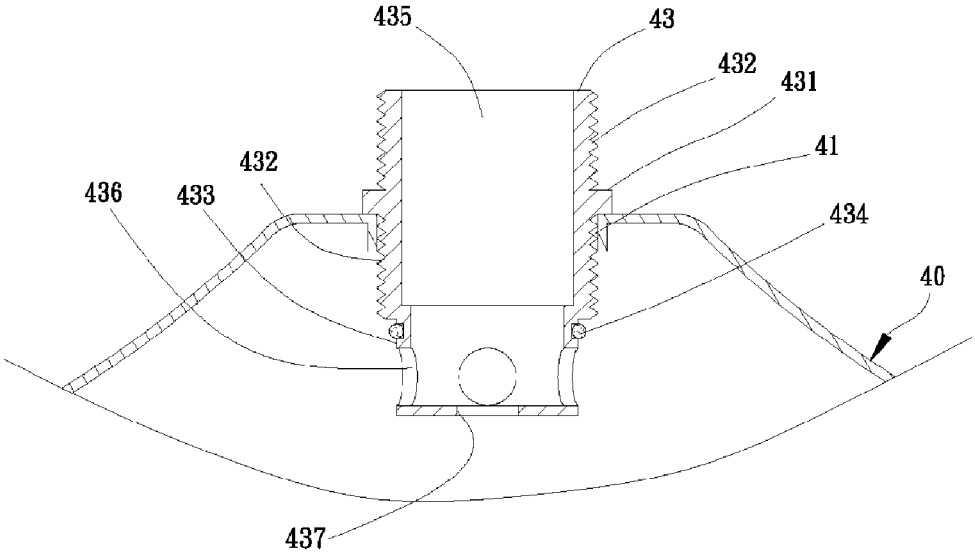
A – A
FIG. 4-A
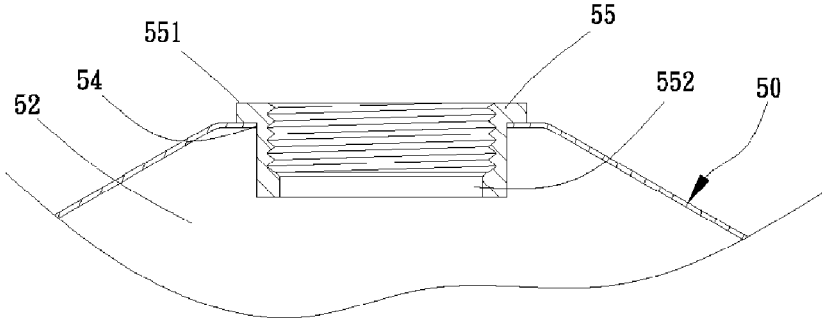
B – B
FIG. 4-B

SPRAYING HEAD FOR BATHING

BACKGROUND OF THE INVENTION

1. Field of the Invention

The present invention relates to a spraying head, and more particularly to a spraying head for bathing which is connected to a wall pipe, and when in use, the water is flowed into the spraying head from the wall pipe and then sprayed out of a water outlet panel.

2. Description of the Prior Art

Referring to FIGS. 1 and 2, a conventional spraying head for bathing comprises an outer housing 10, an inner housing 20 and a bolt 30. A through hole 11 is defined in a center of a top edge of the outer housing 10, an abutting portion 12 is outward bent from a lower end of the outer housing 10, and a tube-shaped locking seat 13 is mounted in the through hole 11. An intermediate portion of the locking seat 13 is disposed with a protruding ring 131 abutted against a periphery of an upper end of the through hole 11, and the upper end of the locking seat 13 is formed with outer threads 132. A chamber 133 is formed in the locking seat 13, a through hole 134 is defined in a bottom surface of the chamber 133, and in a periphery of a lower edge of the chamber 133 is disposed a plurality of water outlet openings 135. The inner housing 20 is mounted in the outer housing 10, the bottom of the inner housing 20 is combined with a water outlet panel 21, and a wrapping section 22 mounted with a water-stop washer 23 in a periphery thereof is disposed in a periphery of the bottom of the inner housing 20. In a center of a top edge of the inner housing 20 is formed a positioning hole 24, a locking member 25 having inner threads 251 is mounted in the positioning hole 24, and in a periphery of the positioning hole 24 is defined a plurality of water inlet holes 26. A bolt 30 is passed through the through hole 134 of the locking seat 13 of the outer housing 10 from up to down and is threaded with the inner threads 251 of the locking member 25 of the inner housing 20 in such a manner that the inner housing 20 is moved upwardly, enabling the water-stop washer 23 of the inner housing 20 to abut against the inner edge of the abutting portion 12 of the outer housing 10, so as to form a sealing condition.

With reference to FIG. 3, when in use, the joint is connected to a wall pipe, and when the water tap is opened, the water is firstly flowed into the outer housing 10 from the wall pipe via the joint and the water outlet openings 135 of the locking seat 13 to lash the upper surface of the inner housing 20, and then flowed into the inner housing 20 from the water inlet holes 26 and sprayed out of the spraying head of the water outlet panel 21.

However, the conventional spraying head for bathing still has the following disadvantages:

Firstly, since the conventional spraying head for bathing is generally used in SPA, the inlet water must be pressurized by a pressurization motor, and the inner housing 20 is fixed in the outer housing 10 by the bolt 30. Thereby, when the water is flowed into the outer housing 10 via the water outlet openings 135 of the locking seat 13 to lash the upper surface of the inner housing 20, the outer housing 10 is likely to be deformed downward because of the weight of the water and plus the powerful water pressure, causing the leakage of the water from the inner housing 20 and the outer housing 10, and even the falling off of the inner housing 20.

Secondly, the water sprayed out of the spraying head of the water outlet panel 21 must be via the water inlet holes 26 of the inner housing 20 firstly, such that the water inlet quantity is reduced greatly and the water cannot be discharged smoothly.

The present invention has arisen to mitigate and/or obviate the afore-described disadvantages.

SUMMARY OF THE INVENTION

The present invention is to provide a spraying head for bathing comprises an outer housing and an inner housing. A through hole is defined in a center of a top edge of the outer housing and is mounted with a locking seat, an intermediate portion of an outer edge of the locking seat is disposed with a protruding ring, and the upper and lower sides of the protruding ring are formed with outer threads. An engaging section with a small diameter is formed on a lower end of the locking seat, and a water-stop ring is mounted on an upper side of an outer periphery of the engaging section. A chamber is formed in the locking seat, in a periphery of a lower edge of the chamber is disposed a plurality of water outlet openings, and a through hole is defined in a bottom surface of the locking seat. The inner housing is mounted in the outer housing, the bottom of the inner housing is combined with a water outlet panel having a center hole, and an L-shaped wrapping section is disposed in a periphery of a bottom side of the inner housing. In a center of a top edge of the inner housing is formed a positioning hole mounted with a locking assembly, and a protruding ring is disposed in an upper end of an outer periphery of the locking assembly. Two step-shaped holes are defined in the locking assembly, in an inner edge of the step-shaped hole with a bigger diameter is formed inner threads, and in an inner edge of the step-shaped hole with a small diameter is formed an abutting flange having a chamfer in the upper end thereof. The inner threads of the locking assembly of the inner housing are threaded with the outer threads of the locking seat of the outer housing in such a manner that the abutting flange of the locking assembly is abutted against the water-stop ring of the locking seat, so as to form a sealing condition. Further, a bolt is passed through the through hole of the locking seat of the outer housing and the center hole of the water outlet panel of the inner housing, and cooperates with a spacer and a special nut, thus finishing the assembly of the inner housing and the outer housing.

The primary objective of the present invention is to provide a spraying head for bathing, wherein the inner housing and the outer housing are locked by a bolt and a nut directly, thus providing a stable assembly. In addition, the locking seat of the outer housing is connected to the water outlet panel of the inner housing by the bolt therebetween. And when in use, the water is flowed into the inner housing directly via the water outlet openings of the locking seat, and then sprayed out of the spraying head of the water outer panel, so as to prevent the occurrence of deformation and falling off of parts.

The further objective of the present invention is to provide a spraying head for bathing, wherein the water is flowed into the inner housing directly via the water outlet openings of the locking seat, and then sprayed out of the spraying head of the water outlet panel, thus ensuring the water inlet quantity and the smooth of the discharging water.

The present invention will become more obvious from the following description when taken in connection with the accompanying drawings, which show, for purpose of illustrations only, the preferred embodiments in accordance with the present invention.

BRIEF DESCRIPTION OF THE DRAWINGS

FIG. 4-A is a partial cross sectional view of an outer housing of the spraying head for bathing in accordance with the present invention;

FIG. 4-B is a partial cross sectional view of an inner housing of the spraying head for bathing in accordance with the present invention;

DETAILED DESCRIPTION OF THE PREFERRED EMBODIMENTS

Figure 1:
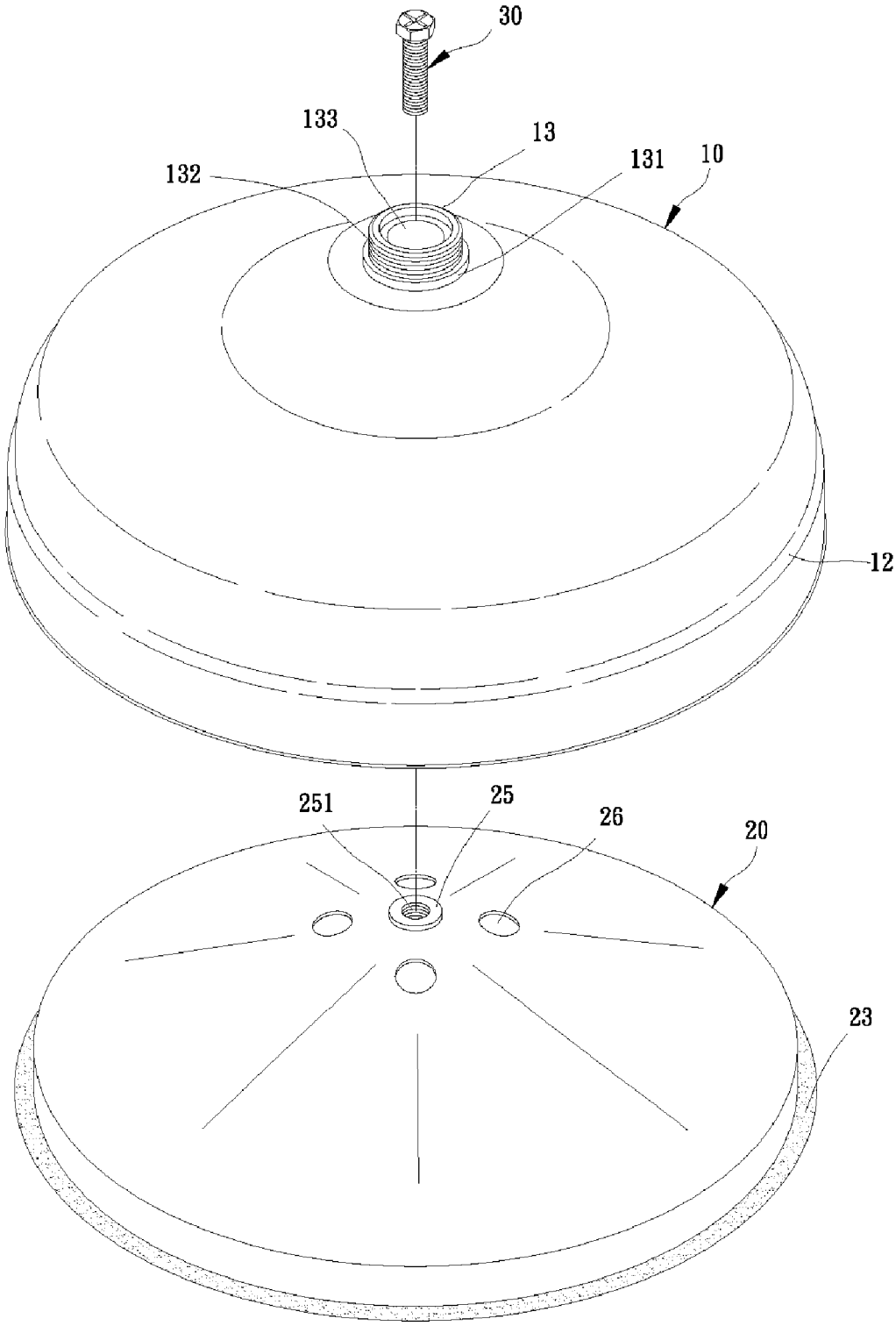
FIG. 1 PRIOR ART
FIG. 1 is an exploded view of a conventional spraying head for bathing.
Figure 2:
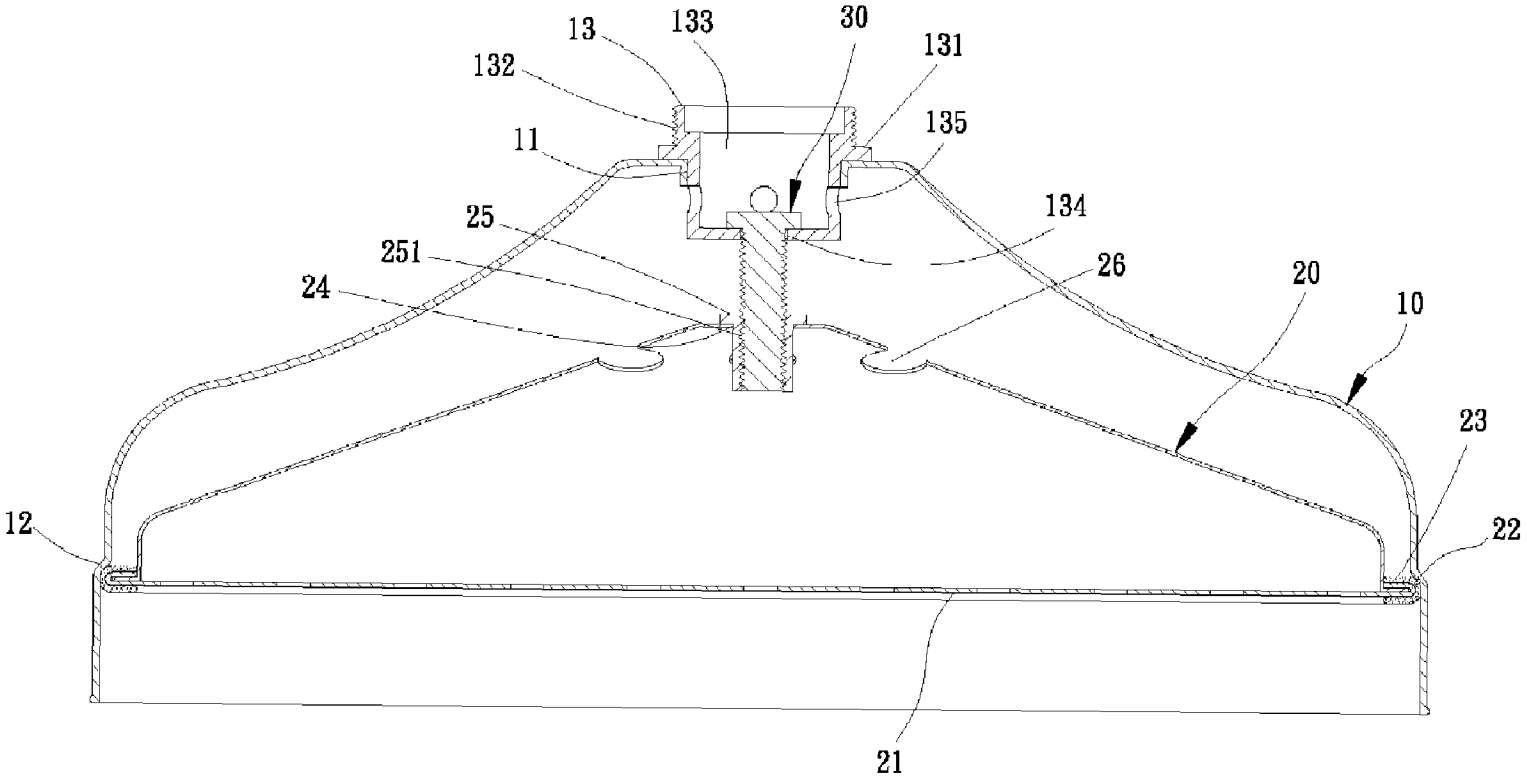
FIG. 2 PRIOR ART
FIG. 2 is an assembly cross sectional view of the conventional spraying head for bathing.
Figure 3:
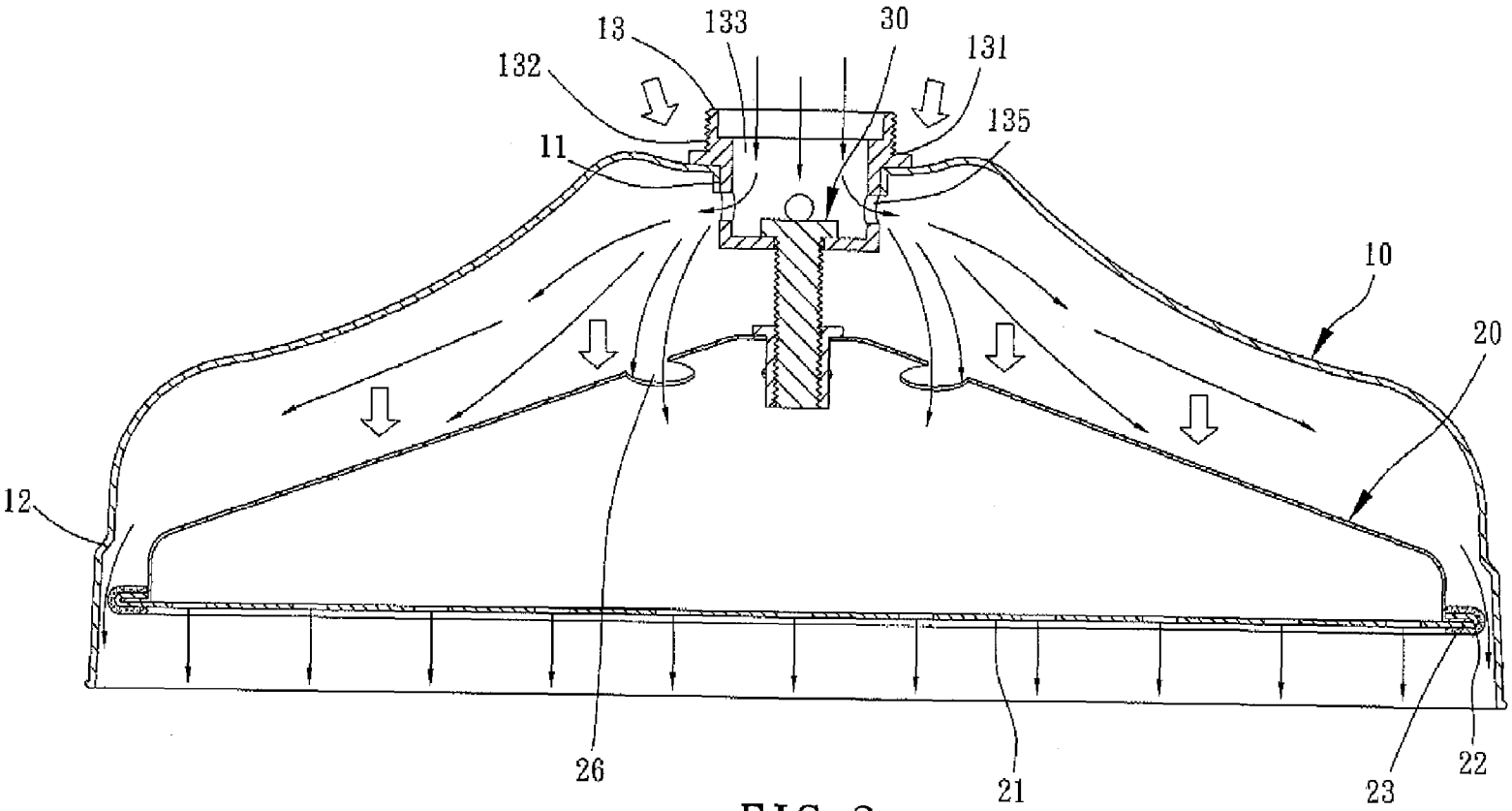
FIG. 3 PRIOR ART
FIG. 3 is a cross sectional illustrative view of showing the water outlet condition of the conventional spraying head for bathing.
Figure 4:
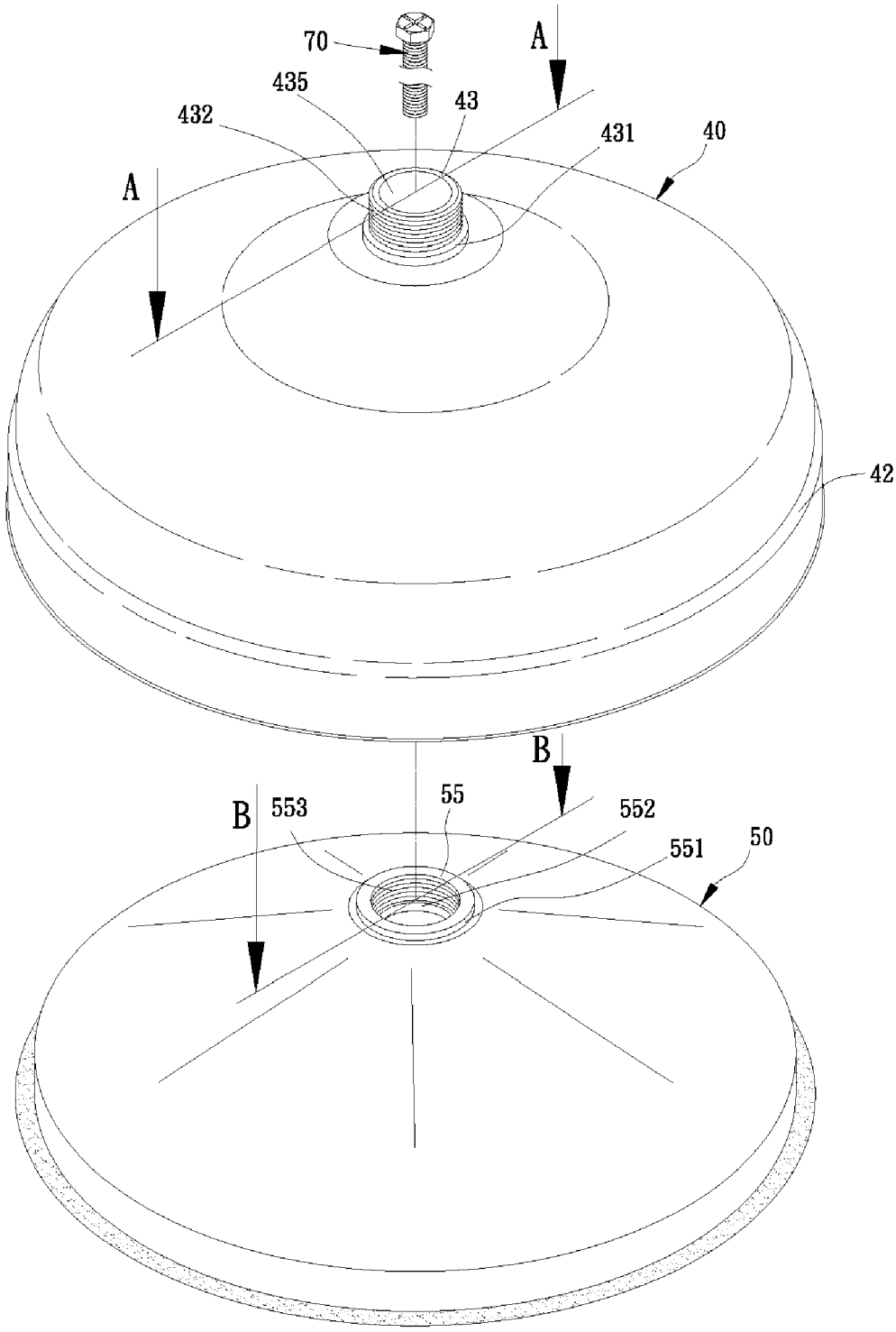
FIG. 4 is an exploded view of a spraying head for bathing in accordance with the present invention.
Figure 5:
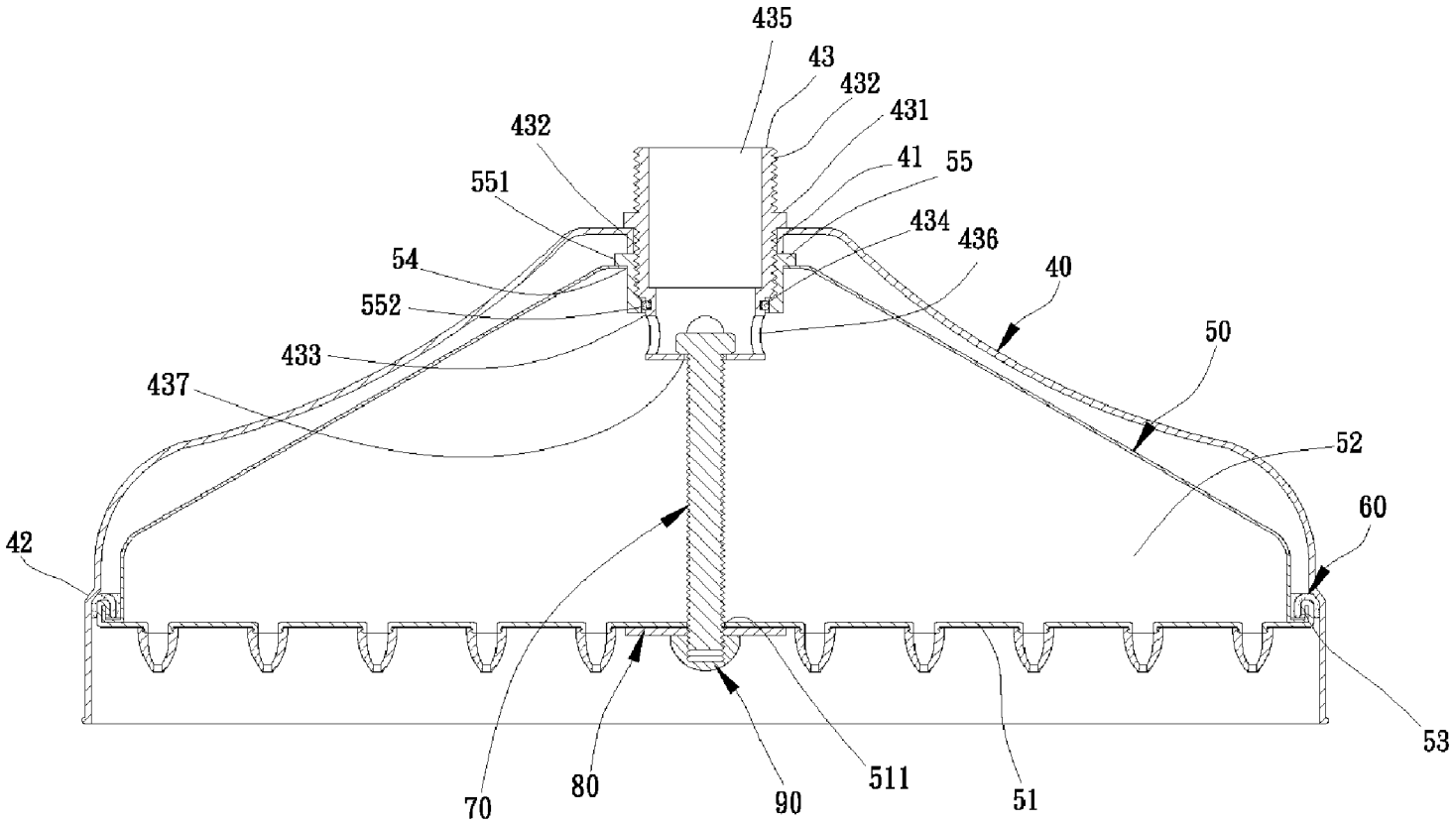
FIG. 5 is an assembly cross sectional view of the spraying head for bathing in accordance with the present invention.

Referring to FIGS. 4, 4-A, 4-B and 5, a spraying head for bathing in accordance with the present invention comprises an outer housing 40 and an inner housing 50. A through hole 41 is defined in a center of a top edge of the outer housing 40, an abutting portion 42 is outward bent from a lower end of the outer housing 40, and a tube-shaped locking seat 43 is mounted in the through hole 41. An intermediate portion of an outer edge of the locking seat 43 is disposed with a protruding ring 431 abutted against a periphery of an upper end of the through hole 41, and the upper and lower sides of the protruding ring 431 are formed with outer threads 432. An engaging section 433 with a small diameter is formed on a lower end of the locking seat 43, and a water-stop ring 434 is mounted on an upper side of an outer periphery of the engaging section 433. A chamber 435 is formed in the locking seat 43, in a periphery of a lower edge of the chamber 435 is disposed a plurality of water outlet openings 436 that are located correspondingly to the lower side of the engaging section 433, and a through hole 437 is defined in a bottom surface of the locking seat 43. The bottom of the inner housing 50 is combined with a water outlet panel 51 having a center hole 511, a receiving room 52 is formed in the inner housing 50, and an L-shaped wrapping section 53 is disposed in a periphery of a bottom side of the inner housing 50. In a center of a top edge of the inner housing 50 is formed a positioning hole 54, and a tube-shaped locking assembly 55 is mounted in the positioning hole 54. A protruding ring 551 is disposed in an upper end of an outer periphery of the locking assembly 55 and is abutted against the periphery of the upper end of the positioning hole 54. Two step-shaped holes are defined in the locking assembly 55, in an inner edge of the step-shaped hole with a bigger diameter is formed inner threads 552, and in an inner edge of the step-shaped hole with a small diameter is formed an abutting flange 553 having a chamfer in the upper end thereof.

During assembly, the inner housing 50 is mounted in the outer housing 40 from down to up, and the inner threads 552 of the locking assembly 55 of the inner housing 50 are threaded with the outer threads 432 of the locking seat 43 of the outer housing 40 in such a manner that the abutting flange 553 of the locking assembly 55 is abutted against the water-stop ring 434 of the locking seat 43, so as to form a sealing condition. At the same time, the L-shaped wrapping section 53 of the inner housing 50 is abutted against the inner edge of the abutting portion 42 of the outer housing 40 by cooperating with a soft washer 60. Further, a bolt 70 is passed through the through hole 437 of the locking seat 43 of the outer housing 40 and the center hole 511 of the water outer panel 51 of the inner housing 50, and cooperates with a spacer 80 and a special nut 90, thus finishing the assembly of the inner housing 50 and the outer housing 40. In addition, the spacer 80 and the special nut 90 can be independent members or integrally formed.

Figure 6:
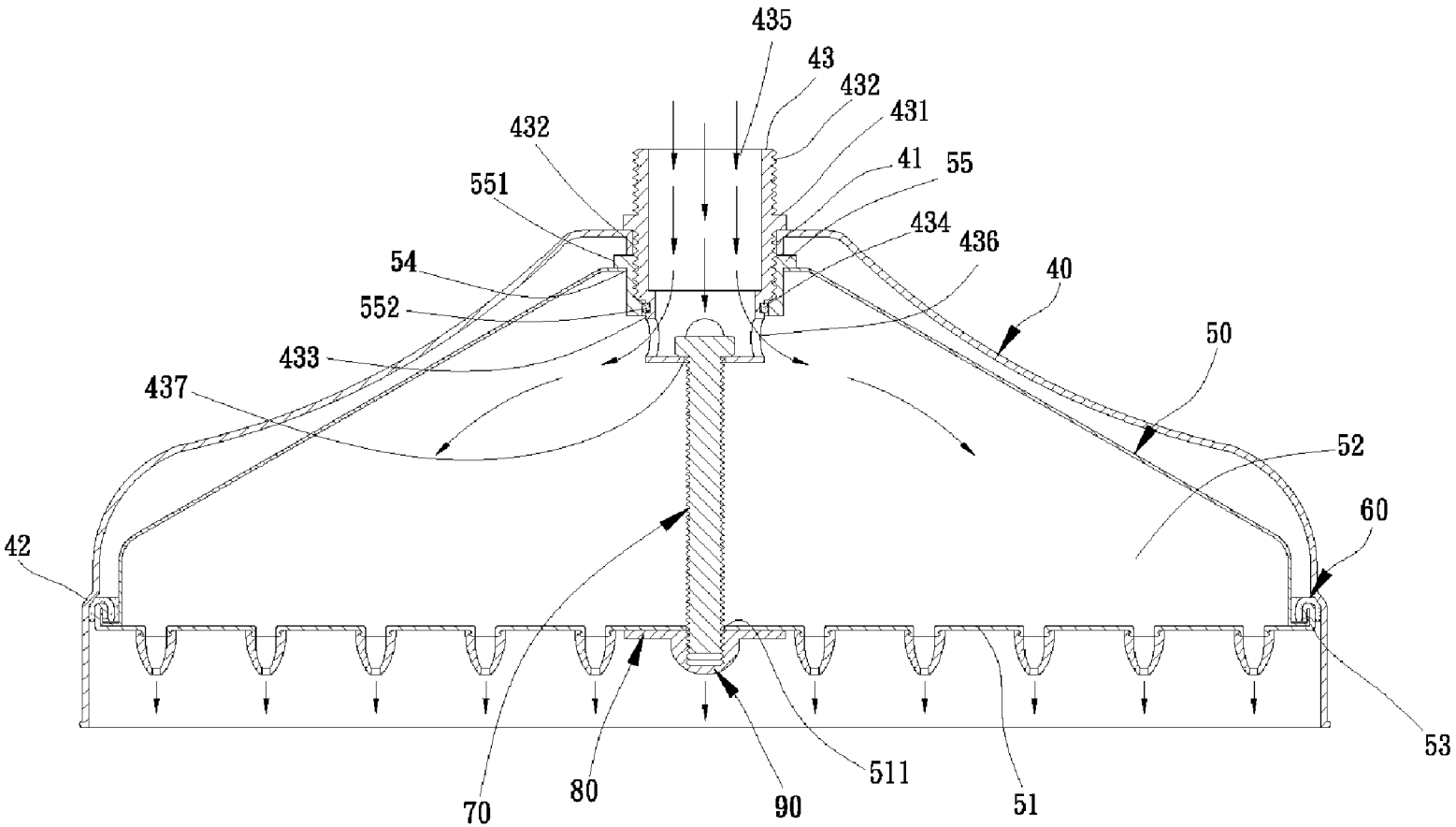
FIG. 6 is a cross sectional illustrative view of showing the water outlet condition of the spraying head for bathing in accordance with the present invention.

With reference to FIG. 6, when in use, the joint is connected to a wall pipe, and when the water tap is opened, the water is flowed into the inner housing 50 from the wall pipe via the joint and the water outlet openings 436 of the locking seat 43 directly, and then sprayed out of the spraying head of the water outlet panel 51.

For the above-mentioned structure, the present invention has the following advantages:

Firstly, the inner housing 50 and the outer housing 40 are locked by a bolt and a nut directly, thus providing a stable assembly. In addition, the locking seat 43 of the outer housing 40 is connected to the water outlet panel 51 of the inner housing 50 by the bolt 70 therebetween, thus supporting the water outlet panel 51. And when in use, the water is flowed into the inner housing 50 directly via the water outlet openings 436 of the locking seat 43, and then sprayed out of the spraying head of the water outlet panel 51, so as to prevent the occurrence of deformation and falling off of parts.

Secondly, the water is flowed into the inner housing 50 directly via the water outlet openings 436 of the locking seat 43, and then sprayed out of the spraying head of the water outlet panel 51, thus ensuring the water inlet quantity and the smooth of the discharging water.

While we have shown and described various embodiments in accordance with the present invention, it should be clear to those skilled in the art that further embodiments may be made without departing from the scope of the present invention.

What is claimed is:

1. A spraying head for bathing, comprising: an outer housing and an inner housing, a through hole defined in a center of a top edge of the outer housing, a locking seat mounted in the through hole, an intermediate portion of an outer edge of the locking seat disposed with a protruding ring, a chamber formed in the locking seat, in a periphery of a lower edge of the chamber are a plurality of water outlet openings, the inner housing mounted in the outer housing, the bottom of the inner housing combined with a water outlet panel, in a center of a top edge of the inner housing is formed a positioning hole, a locking assembly mounted in the positioning hole, and a protruding ring disposed in an upper end of an outer periphery of the locking assembly, the outer housing having a lower side of the protruding ring of the locking seat formed with outer threads, an engaging section with a small diameter is formed on a lower end of the locking seat, a water-stop ring is mounted on an upper side of an outer periphery of the engaging section, and a through hole is defined in a bottom surface of the locking seat;

the inner housing including the water outlet panel having a center hole, two step-shaped holes are defined in the locking assembly, in an inner edge of the step-shaped hole with a bigger diameter is formed with inner threads, in an inner edge of the step-shaped hole with a small diameter is formed with an abutting flange, the inner threads of the locking assembly of the inner housing are threaded with the outer threads of the locking seat of the outer housing in such a manner that the abutting flange of the locking assembly is abutted against the water-stop ring of the locking seat, so as to form a sealing condition, further, a bolt is passed through the through hole of the locking seat of the outer housing and the center hole of the water outlet panel of the inner housing, and cooperates with a spacer and a nut, thus finishing the assembly of the inner housing and the outer housing.

2. The spraying head for bathing as claimed in claim 1, wherein the water outlet openings of the locking seat of the outer housing are located at a lower side of the engaging section and are protruded out of the lower side of the locking assembly of the inner housing after the assembly of the inner housing and the outer housing.

3. The spraying head for bathing as claimed in claim 1, wherein an L-shaped wrapping section is disposed in a periphery of a bottom side of the inner housing.

* * * * *